US009097040B2

(12) United States Patent
Toennies et al.

(10) Patent No.: US 9,097,040 B2
(45) Date of Patent: Aug. 4, 2015

(54) HANDLE FOR THE INSIDE OF A DOOR OF A MOTOR VEHICLE

(71) Applicant: FORD GLOBAL TECHNOLOGIES, LLC, Dearborn, MI (US)

(72) Inventors: Stefan Toennies, Köln (DE); Frank Speer, Leverkusen (DE)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 14/178,485

(22) Filed: Feb. 12, 2014

(65) Prior Publication Data

US 2014/0245570 A1 Sep. 4, 2014

(30) Foreign Application Priority Data

Mar. 1, 2013 (DE) ..... 10 2013 203 543

(51) Int. Cl.
*E05B 79/06* (2014.01)
*E05B 85/12* (2014.01)

(52) U.S. Cl.
CPC ..... *E05B 79/06* (2013.01); *E05B 85/12* (2013.01); *Y10T 16/458* (2015.01)

(58) Field of Classification Search
CPC ..... Y10T 16/44; Y10T 16/458; Y10T 16/48; Y10T 16/498; E05B 1/0015; E05B 79/06; E05B 85/12; B60N 3/026; B60R 13/0243; E05Y 2900/531
USPC ..... 16/412, 110.1, 431, 436; 296/146.1, 296/146.7, 1.02, 153; 292/336.3; 49/460
See application file for complete search history.

(56) References Cited

U.S. PATENT DOCUMENTS

| | | | | |
|---|---|---|---|---|
| 6,149,224 | A * | 11/2000 | Tiberia et al. | 296/146.7 |
| 6,409,249 | B1 * | 6/2002 | Han | 296/146.7 |
| 7,343,646 | B2 * | 3/2008 | Hayashi | 16/412 |
| 7,380,864 | B2 * | 6/2008 | Guanzon et al. | 296/146.1 |
| 7,404,588 | B2 * | 7/2008 | Gabsch et al. | 296/146.7 |
| 7,905,059 | B2 * | 3/2011 | Senoo | 49/503 |
| 8,113,561 | B2 * | 2/2012 | Yamada et al. | 296/1.02 |
| 8,128,152 | B2 | 3/2012 | Cho | |
| 8,292,344 | B2 * | 10/2012 | Yamaguchi et al. | 296/1.02 |
| 2007/0024085 | A1 * | 2/2007 | Steelman | 296/153 |
| 2012/0222360 | A1 * | 9/2012 | Schryer | 49/460 |

* cited by examiner

*Primary Examiner* — William Miller
(74) *Attorney, Agent, or Firm* — Vichit Chea

(57) ABSTRACT

A door handle for the inside of a motor vehicle door includes a mounting region and a gripping region. The handle is formed as a basic body which is substantially U-shaped with two leg portions connected by a base member. The gripping region is formed on a first leg portion and the mounting region is formed on the second leg portion of the basic body. The first and second leg portions point in substantially the same direction so that door opening and closing forces applied to the gripping region substantially avoid creating torque at the mounting region.

15 Claims, 4 Drawing Sheets

HANDLE FOR THE INSIDE OF A DOOR OF A MOTOR VEHICLE

CROSS REFERENCE TO RELATED APPLICATIONS

This application claims priority to application 102013203543.8, filed in the German Patent and Trademark Office on Mar. 1, 2013, which is hereby incorporated by reference.

STATEMENT REGARDING FEDERALLY SPONSORED RESEARCH

Not Applicable.

BACKGROUND OF THE INVENTION

The invention relates to a handle for the inside of the door of a motor vehicle, said handle including a mounting region, which is realized for attaching the handle on the inside of the door, and a gripping region, which is realized for the handling of the handle by a user. The invention also includes a motor vehicle door having such a handle.

These types of handles are provided on the inside of the doors of motor vehicles in order to make it possible for people to open and close the door from the inside. In this case, a person grips the handle and either pulls the door toward oneself or pushes it away from oneself in order to move the door in a corresponding manner. Typically, it is possible to incorporate such a handle into the form of an arm rest, but separate handles are also known which make it possible for the handle to be mounted and aligned more freely without limitations in placement that are imposed as a result of integration with the arm rest.

However, separately attached handles also have to withstand the various forces applied during use, and should be mounted in as ergonomic a manner as possible. They should not be the cause of injuries in the event of accidents, and should merge well into the appearance of the paneling on the inside of a door.

For example, U.S. Pat. No. 8,128,152 describes a handle device for the door paneling of a motor vehicle, said handle device having a handle which has a top end and a bottom end. A fastening portion, by way of which the handle is able to be fastened on an arm rest of the door paneling, is formed on the bottom end of the handle. The top end, in contrast, is in the form of a handle which projects from the top end. The handle, in this case, is O-shaped such that a handle opening is formed in which a user is able to grasp. The handle is also constructed of three parts, there being an inner and outer handle preferably of plastics material, between which a reinforcement part of steel is attached. The inner handle part forms the fastening portion, by way of which the entire handle is able to be mounted on the arm rest. Several grooves, bores, pins, etc. can be provided for this purpose, it also being possible to provide a reinforcement plate on the paneling on the inside of the door in order to increase the stability of the handle mounted thereon.

However, the disadvantage of this type of handle is that when the handle is actuated by gripping the top region, considerable torque is generated in the bottom region in the fastening portion. Depending on the varying direction of pulling or pushing when opening and closing the associated door, torque with the most varied directions or axes of rotation can occur such that the fastening has to be redundantly carried out with several screws so that the handle does not become loose after a certain time.

In addition, upwardly oriented handles with an O-shaped opening are frequently ergonomically unfavorable as, in particular for large people, they do not provide an adequate opportunity for gripping the handle in a suitable manner. Relatively small openings in the handle also impair the ergonomy when people with large hands are not able to reach through them.

Consequently, it is the object of the invention to provide a handle for the inside of the door of a motor vehicle, said handle being able to be mounted simply, sturdily and in as ergonomic a manner as possible. In addition, it is the object of the invention to provide a motor vehicle door having such a handle.

SUMMARY OF THE INVENTION

The handle as claimed in the invention is suitable for attachment on the inside of the door of a motor vehicle and includes a mounting region, which is realized for attaching the handle on the inside of the door, and a gripping region, which is realized for the handling of the handle by a user. In this case, the handle is separate from an arm rest and includes a basic body which is realized in a substantially U-shaped manner with two leg portions and a base member which connects the two leg portions together, wherein the gripping region is formed on a first leg portion, whilst the mounting region is formed on the second leg portion of the basic body.

As a result of said U-shaped form of the basic body of the handle, the handle can be mounted on the inside of the door of a motor vehicle by way of the first leg portion of the mounting region, whilst the second leg portion extends with the gripping region at the front of the inside of the door and thus is able to be gripped by a person. In this case, the mounting region and consequently the associated fastening points lie behind the gripping region. If someone pulls horizontally on the gripping region in order to close the door for example, hardly any torque is generated in the mounting region as a result of said force, but predominantly pulling forces. The fastening of the handle on the inside of the door is consequently exposed to less torque and can be realized in a correspondingly simpler manner and/or is more sturdy than other fastenings. It is also possible for the handle to be mounted directly on the door body or on rigid trim paneling on the inside of the door.

The handle region can be realized integrally with the basic U-shaped body, whereby a gripping element which forms the gripping region is mounted on the first leg portion of the basic body. The advantage of the second variant is that the gripping region can be formed from a different material to the rest of the handle and consequently in particular the mounting region. For example, the basic body can consist of metal such that the mounting region is also of metal, whilst the at least one gripping element consists at least in part of plastics material. Thus, the mounting region can be formed in as sturdy a manner as possible from metal, the gripping element, however, consisting in a visually and haptically appealing manner of one or several plastics material components.

In order to fasten the handle on the inside of a door, at least two mounting bores can be provided on the second leg portion of the mounting region. The handle can then be tightened so as to be held in place by means of said bores and associated screws, the bores being arranged in such a manner in the mounting region that they absorb the occurring forces and torque in as optimum a manner as possible without the handle becoming damaged as a result of the constant load. The bores can be supplemented in the mounting region by pins, grooves, webs and/or latching means, by way of which the handle is able to be aligned simply on the door for the correct mounting.

In order to facilitate the mounting of the handle, the first leg portion with the gripping region can be formed in such a manner that the mounting region lying behind it is nevertheless accessible with a tool. For example, at least two access bores which are aligned with the mounting bores in the mounting region can be provided in the first leg portion of the gripping region for this purpose. Thus, it is possible to push a screwdriver through said access bores in order to mount screws on the other side. In this case, it can be provided that one or more gripping elements are only mounted on the first leg portion to realize the gripping region once the basic body has been mounted on the door in order to form the gripping region in this manner and to cover the access bores. In this case, the access bores can also serve for aligning and/or fastening the gripping elements on the basic body.

The entire handle and consequently also the basic body of the handle can be formed differently within the framework of the basic U-shaped form. For example, the two leg portions can extend substantially in the same direction, or even parallel to one another. In particular, however, the gripping region can also be lightly curved, the two leg portions, however, always still extending substantially in the same direction.

Included in the U-shaped form of the handle as claimed in the invention, is also an embodiment where the handle is twisted in the region of the base member between the two leg portions such that the leg portions do not extend parallel to one another. The two leg portions shear apart and point in slightly different directions. As a result, the mounting of the handle is made easier as the gripping region no longer lies directly in front of the mounting region and the mounting region is thus more easily accessible. In said embodiment, no access bores, for example, have had to be provided inside the gripping region in order to obtain access to fastening screws with a screwdriver as the gripping region does not cover the mounting region. It is true the point of application of force when the handle is actuated then no longer lies precisely in front of the mounting region such that more torque acts on the mounting region, but nevertheless said embodiment has advantages compared to conventional handles.

The basic body is preferably formed by a U-shaped profile which is composed of two plates for the leg portions and one plate for the base member between the two plates. The material thickness of the profile, in this case, lies approximately in the range between 2 and 5 mm. The length L of the leg portions can be between about 100 and 200 mm, for example.

A sufficiently large mounting region which ensures a good hold of the handle on the door can be realized on the one hand as a result of the handle having such dimensions. In addition, the material thickness is large enough to withstand bending forces which occur in particular at the base member or the respective transitions/edges between the two leg portions and the base member when the handle is actuated. In this case, at least one edge between the leg portions and the base member can be rounded-off. The distance between the two leg portions is additionally sufficiently large so that a space is provided to enable a person to engage properly behind the gripping region.

The basic U-shaped form of the handle as claimed in the invention can be additionally supplemented by any webs, indentations or bulges, etc. For example, the second leg portion of the mounting region can have at least one reinforcement web which protrudes at an angle from the second leg portion in the direction of the first leg portion. Such a reinforcement web can be formed, for example, by a rod, a tube or a plate which are mounted on side edges of the two leg portions or in the area thereof.

In this case, the reinforcement web can project from the second leg portion up to the first leg portion and can even be fixedly connected thereto. The basic body, which is formed by the first leg portion with the gripping region and the second leg portion with the mounting region, is accordingly still U-shaped, but components or regions which give the entire body a somewhat other form are able to be connected to said U-shaped form. If, for example, a plate which adjoins the side edge of a plate-shaped leg portion is chosen as the reinforcement web, said plate together with the U-shaped profile of the basic body realizes a type of box. Said plate-shaped reinforcement web can also serve as a support for door switch elements (e.g., for power windows or power locks) and can contribute to the increase in the stability of the handle by increasing the rigidity against torsion. However, the handle can also be fastened to the door by way of said reinforcement plate in addition to the mounting region, as a result of which the position and alignment of fastening points can be optimized.

The invention also includes a motor vehicle door, comprising at least one handle which is mounted on the inside of the door by way of a mounting region. The handle, in this case, is developed as claimed in one or several of the described embodiments.

The handle as claimed in the invention can be mounted on the door at different alignments in order to attach it in the most ergonomically favorable manner possible. In this case, the mounting is independent of other components such as arm rests such that the handle can be mounted precisely at the position and at the alignment which have been determined as ergonomically favorable. If other operating units, such as window openers and/or locking mechanisms, are located in the desired region, the handle can also be mounted such that said operating units extend at least in part between the two leg portions of the handle. The distance between the mounting region and the gripping region has then only to be chosen to be correspondingly large.

The alignment of the handle can be varied such that the free end of the gripping region points to the stop side of the motor vehicle door or away from the same. The free end, in this connection, is the end of the leg portion for the gripping region which does not merge into the base member of the U-shaped body. In this case, the handle is preferably mounted inclined on the door, as in this way a person is provided with different possibilities for gripping the handle at different heights and in different horizontal positions. The handle, however, can also point vertically upward or extend horizontally. Consequently, the gripping region can extend at an angle of between 0° and 90° to the horizontal, in particular at an angle of between 20° and 60° to the horizontal.

BRIEF DESCRIPTION OF THE DRAWINGS

Further advantages, characteristics and expedient further developments of the invention are produced from the subclaims and from the following representation of preferred exemplary embodiments by way of the drawings, in which:

DETAILED DESCRIPTION OF PREFERRED EMBODIMENTS

Figure 1:
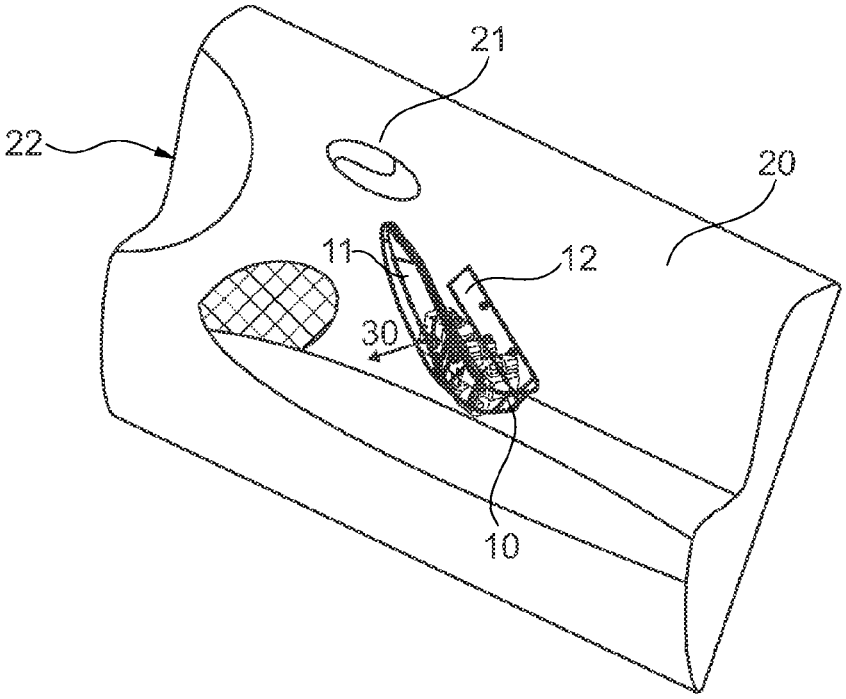
FIG. 1 shows a schematic representation of the attaching and aligning of an exemplary embodiment of the door handle as claimed in the invention on the inside of a door.

FIG. 1 shows a schematic representation of the attaching and aligning of an exemplary embodiment of an inventive handle 10 on the inside 20 of the door. In this case, the door has a stop side 22 on which are located the fittings (i.e., hinges) by way of which the door is attached so as to be pivotable on a motor vehicle (not shown). In addition, on the door there is provided a door opener 21 which is realized as an opening lever, and the door is unlocked preferably as a result of pulling on the opening lever 21 such that by pressing against the handle 10 it can be opened and pivoted outward. Over and above this, the door can be shut by pulling on the handle 10 such that it clicks shut. The pulling direction when closing the door by way of the handle 10 extends corresponding to the arrow 30 shown in a direction perpendicular to the trim paneling 20 on the inside of the door.

The door has paneling 20 on the inside of the door, in which paneling the handle 10 is mounted along with further operating units such as locking mechanisms, window openers, airbags, etc. In this case, the handle 10 is realized in a substantially U-shaped manner, a gripping region 11 being formed on a first leg portion, whilst a second leg portion is realized as a mounting region 12. The two leg portions are connected together by means of a base member which creates a distance between the gripping region 11 and the mounting region 12. In a final assembly, mounting region 12 may be concealed from view by covering with a separate trim piece or by arranging mounting region behind paneling 20 with the base member passing through paneling 20.

As a result of the spatial relationship between the first and second leg portions, door opening and closing forces applied to the gripping region substantially avoid the creation of torque at the mounting region. This is due to the alignment of gripping region 11 with mounting region 12 along the perpendicular direction indicated by arrow 30.

The handle 10 can be aligned differently on the door. In the exemplary embodiment shown in FIG. 1, the open side of the U-shaped handle points away from the stop side 22 of the door. In addition, the longitudinal axis of the gripping region 11 does not extend horizontally or vertically, but at an angle of approximately 45° to the horizontal.

The handle 10 is then attached to the door by means of the mounting region 12 and can be actuated by means of the gripping region 11. In this case, between the two leg portions of the U-shaped handle 10, the base member provides a distance between the gripping region 11 and the paneling on the inside of the door which enables the gripping region 11 to be engaged behind. The mounting region 12 and the base member of the U-shaped handle 10, however, can also be sunk behind the paneling on the inside of the door that simply the gripping region 11 projects out of said paneling. In order to be able to engage behind the handle 10 in the case of said embodiment, a cavity can be formed inside the paneling 20 on the inside of the door in the region of the gripping region 11.

Figure 2:
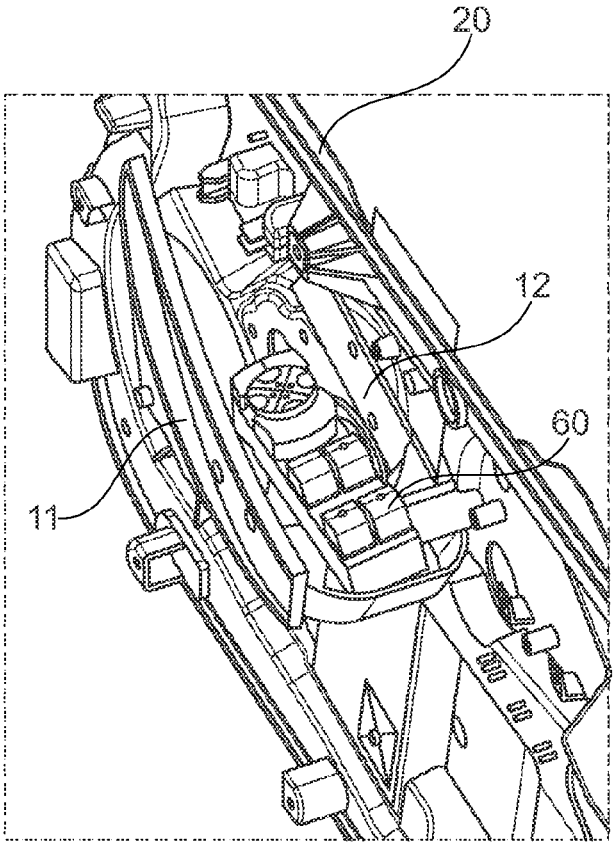
FIG. 2 shows a schematic representation of the attaching of an exemplary embodiment of the door handle as claimed in the invention with reference to further components of a door.

If the mounting region 12 is sunk to a sufficient extent together with the base member of the U-shaped handle 10 in the paneling 20 on the inside of the door, operating units such as, for example, window opener switches 60 can be positioned between the mounting region 12 and the gripping region 11. This can also be seen in detail in the top view in FIG. 2 which shows the attaching of a handle 10 with reference to further components of a door.

Figure 3:
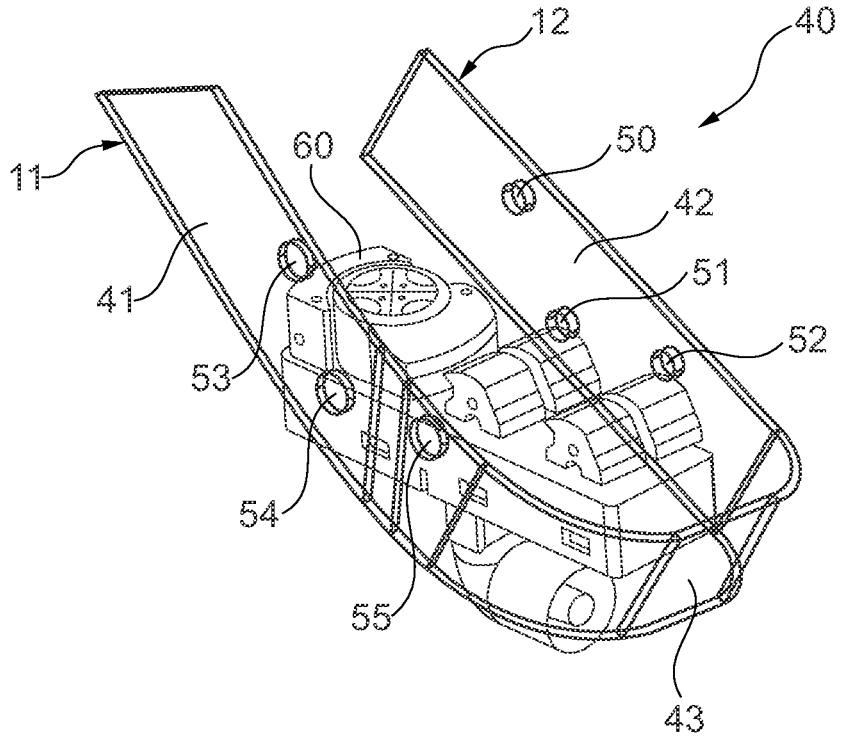
FIG. 3 shows a schematic representation of a first exemplary embodiment of the basic form of the door handle as claimed in the invention.

The handle 10 consists, for example, of a U-shaped basic body which is provided with a gripping element in the gripping region. Such a U-shaped basic body 40 can be seen in the schematic representation of FIG. 3 and can fabricate of metal. The basic body 40 is formed as a U-shaped profile having two leg portions 41 and 42 which are connected together by means of a base member 43. In this case, the edges on the transitions between the leg portions 41, 42 and the base member 43 are rounded-off (i.e., curved).

The two leg portions 41 and 42 extend substantially parallel to one another and are approximately the same in length. The lengths, however, can also be different and the two leg portions do not have to extend parallel to one another, but can point substantially in the same direction. For example, the mounting region 12 can be realized in a planar manner in order to be able to attach it properly to the door, whilst the gripping region 11 is realized in a lightly curved manner. In this case, the curvature of the gripping region 11 preferably points into the interior of the vehicle for ease of use.

The first leg portion 42 forms the mounting region 12 by three mounting bores 50, 51 and 52, for example, being provided there. The handle can be mounted on the paneling 20 or other interior structure on the inside of the door by means of said bores, it being possible to provide a corresponding mounting plate on a backing side of the paneling 20 on the inside of the door. As an alternative to this, the handle can also be fixed directly on the door plate by means of the mounting region 12.

Figure 4:
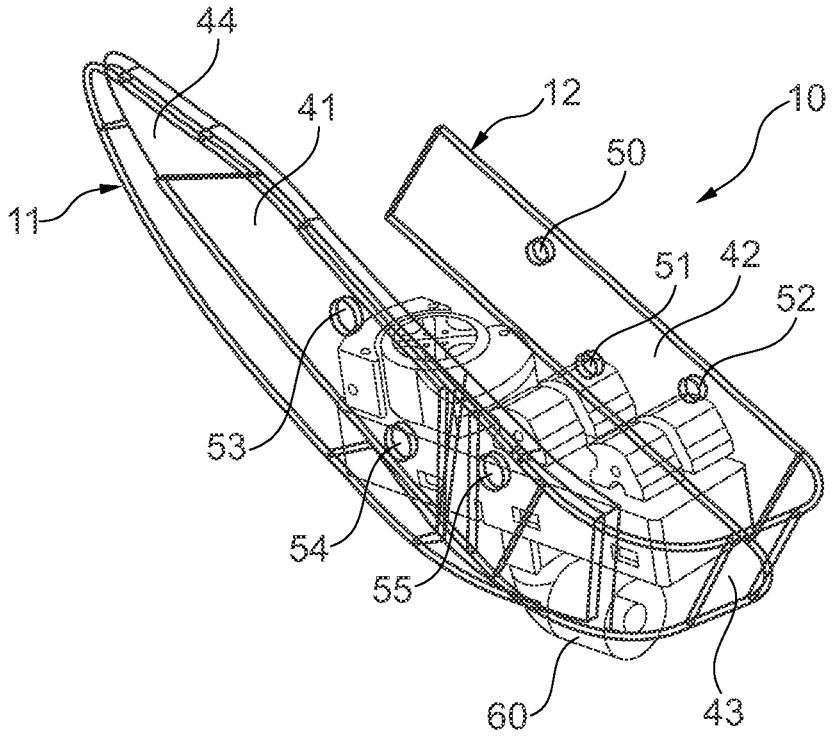
FIG. 4 shows a schematic representation of the door handle according to FIG. 3 with a gripping element attached thereto.

The first leg portion 41 located opposite also has bores, these being three access bores 53, 54 and 55 through which a tool is able to be guided in order to drive screws through the mounting bores 50, 51 and 52, as these latter are otherwise hidden by the first leg portion 41 and can only be accessed with difficulty. The bores 53, 54 and 55 in the first leg portion 41 can additionally be utilized for the purpose of fixing or at least aligning a gripping element 44 on the first leg portion 41, as can be seen in FIG. 4. Gripping element 44 can be formed in a visually attractive manner from a plastics material and fastened on the first leg portion in order to realize a gripping region 11 in this way.

The gripping element 44, in this case, can be in one piece and be pushed over the first leg portion 41, or it is formed in two parts such that part of the gripping element 44 is attached in each case on the outside and the inside of the first leg portion 41. In addition, the gripping element 44 can also project beyond the free end of the first leg portion 41 and, for example, can be formed from a plastics material component which is reinforced by struts, cavities, etc. Over and above this, a cover can be provided in order to cover the access bores 53, 54 and 55 if these latter are also utilized to fasten the gripping element 44 on the first leg portion 41 of the basic body 40.

Figure 5:
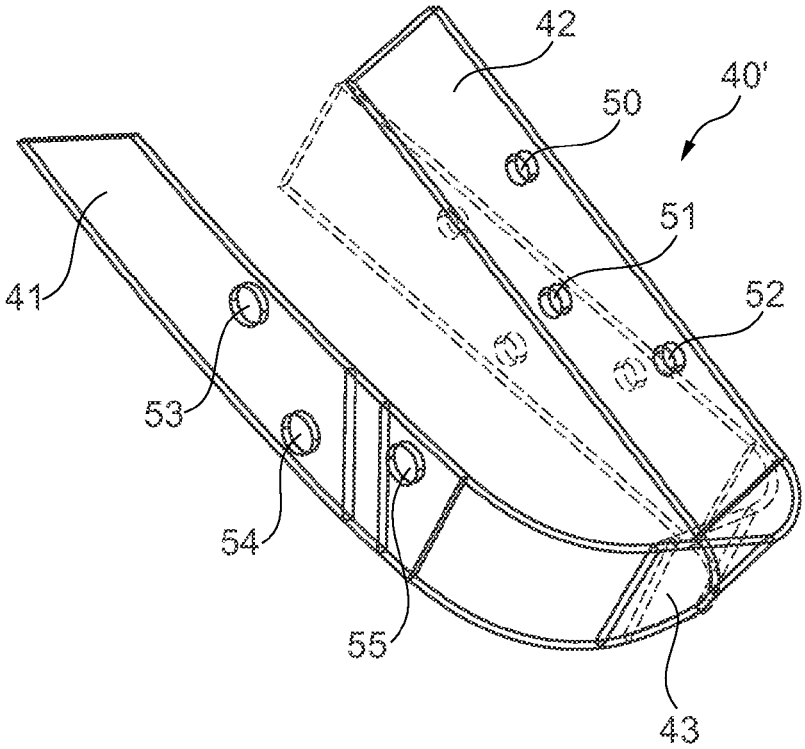
FIG. 5 shows a schematic representation of a second exemplary embodiment of the basic form of the door handle as claimed in the invention.

FIG. 5 shows a schematic representation of a second exemplary embodiment of the basic form of the handle wherein the basic U-shaped body 40' comprises a base member 43 between the two leg portions 41 and 42 which do not point exactly in the same direction, but are at a slight angle with respect to one another. As a result of said form of the basic body 40', the mounting on a door can be simplified as the mounting bores 50, 51 and 52 in the second leg portion 42 are more easily accessible, the original position of the second leg portion 42 without distortion being shown by the broken line in FIG. 5.

Figure 6:
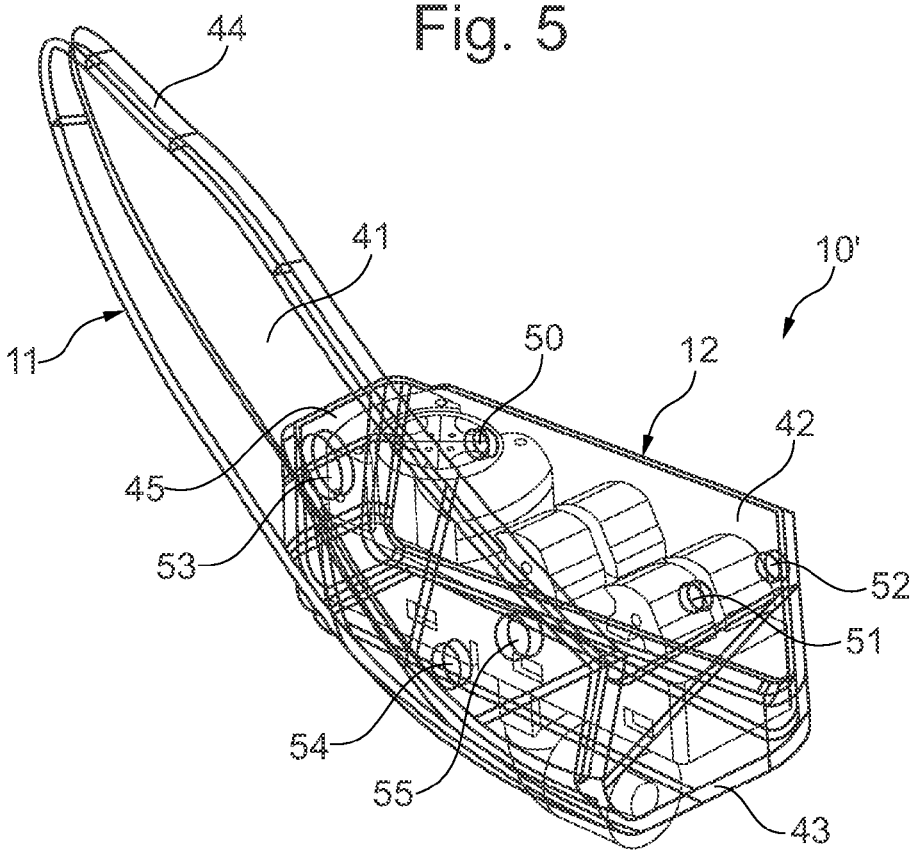
FIG. 6 shows a schematic representation of a third exemplary embodiment of the basic form of the door handle as claimed in the invention

FIG. 6 shows a further embodiment of the handle 10' as claimed in the invention where the basic U-shaped form of the handle is supplemented by further components. In this connection, the base member 43 does not extend so that it connects two long narrow leg portions together, but rather it connects two short wide leg portions. The two leg portions 41 and 42 in FIG. 6 point upward from base member 43 and are connected together by means of the base member 43 lying underneath. The first leg portion 41 includes the gripping element 44 which is attached thereon and protrudes to the left. The second leg portion 42 is realized as a rectangular plate which is connected on one of its long sides to the first leg portion 41 by means of the base member 43. Said form already provides an alternative to the previously described forms, but in the exemplary embodiment of FIG. 6 is supplemented in particular by a reinforcement web 45. Reinforcement web 45 is formed on a short side of the second leg portion 42 as a reinforcement plate and extends at an angle from said second leg portion in the direction of the first leg portion 41. In this case, the reinforcement web 45 can be fixedly connected to the first leg portion 41 and can thus form a cuboid-shaped body, out of which the gripping element 44 projects on one side. The torsional and flexural strength of the handle 10' are increased as a result.

The reinforcement web 45, however, can only project just up to the first leg portion 41, but cannot be connected thereto. In both cases, the reinforcement web can be utilized for the purpose of stabilizing the attaching of the handle on the door. For example, the reinforcement web 45 can be inserted in a positive locking manner into a correspondingly formed receiving means in the door paneling in order, in this way, to prevent the handle being displaced and/or rotated in relation to the door. In addition, the reinforcement web 45 can also be provided with fastening means in order to be able to mount the handle 10' on the door even over the reinforcement web 45. Thus, the handle 10' can be fixed on a door both by means of the mounting region 12 and by means of the reinforcement web 45, it being possible to use screw connections in different planes.

Figure 7:
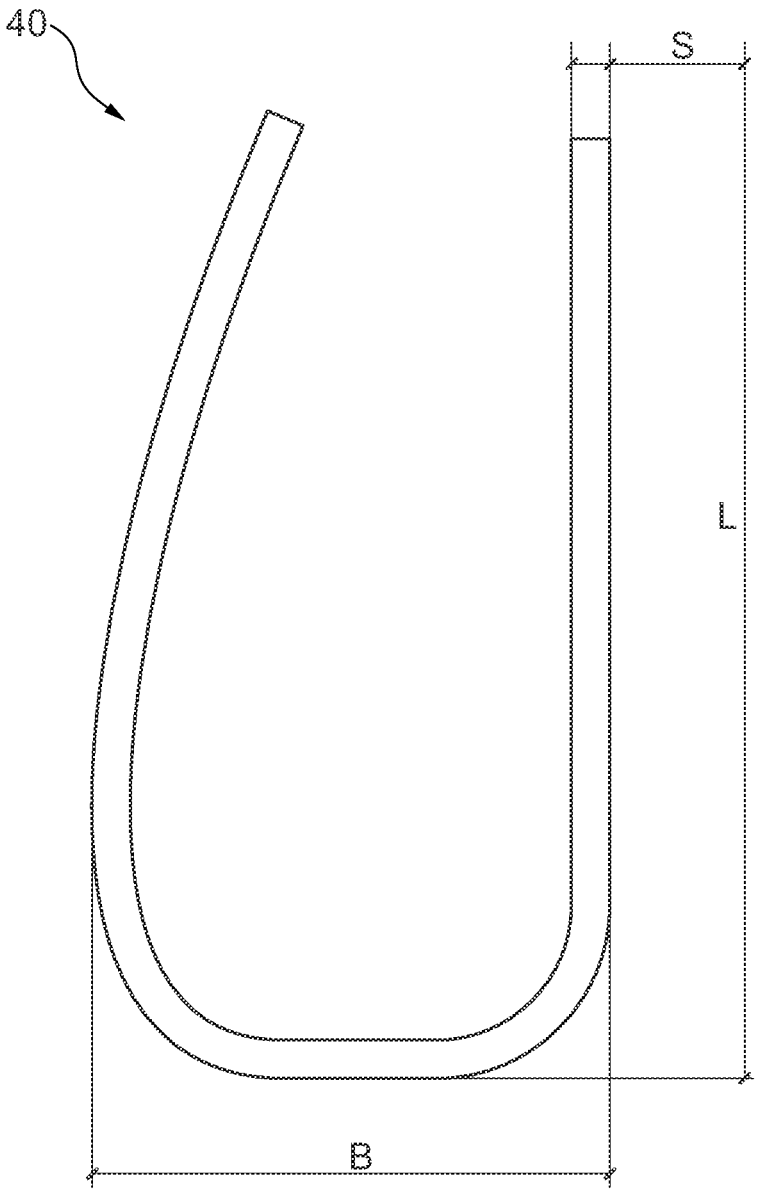
FIG. 7 shows a schematic view of the U-shaped basic body of a handle.

FIG. 7 shows a schematic top view of the U-shaped basic body 40 of a handle in order to indicate the essential dimensions of the basic body in the form of a U-shaped profile. The material thickness S of the profile, in this case, is in the order of magnitude of between 2 and 5 mm. The length L of the leg portions can be between 100 and 200 mm.

What is claimed is:

1. An inside door handle for an interior door panel of a motor vehicle, comprising:

a substantially U-shaped body with first and second leg portions connected by a base member, wherein the base member extends perpendicular to the door panel so that the leg portions extend parallel to the door panel;

wherein a gripping region is formed on the first leg portion for grasping of the handle by a user, wherein a mounting region formed on the second leg portion attaches the handle to the inside of the door panel, and wherein the first and second leg portions point in substantially the same direction so that door opening and closing forces applied to the gripping region substantially avoid creating torque at the mounting region.

2. The handle of claim 1 further comprising a gripping element mounted to the first leg portion.

3. The handle of claim 2 wherein body is comprised of metal, and wherein the gripping element is comprised at least in part of plastics material.

4. The handle of claim 1 wherein at least two mounting bores are provided in the mounting region.

5. The handle of claim 4 wherein at least two access bores are provided in the gripping region aligned with the mounting bores in the mounting region.

6. The handle of claim 1 wherein at least one edge between the leg portions and the base member is rounded-off.

7. The handle of claim 1 wherein the second leg portion has at least one reinforcement web which protrudes at an angle from the second leg portion in the direction of the first leg portion.

8. The handle of claim 7 wherein the at least one reinforcement web projects up to the first leg portion and is fixedly connected to the first leg portion.

9. The handle of claim 8 wherein the at least one reinforcement web is plate-shaped.

10. A motor vehicle door comprising:

a door panel; and substantially U-shaped body with first and second leg portions connected by a base member, wherein the base member extends perpendicular to the door panel so that the leg portions extend parallel to the door panel;

wherein a gripping region is formed on the first leg portion for grasping of the handle by a user, wherein a mounting region on the second leg portion is attached to the door panel, and wherein the first and second leg portions point in substantially the same direction so that door opening and closing forces applied to the gripping region substantially avoid creating torque at the mounting region.

11. The motor vehicle door of claim 10 wherein the gripping region has a free end pointing away from a hinge side of the door.

12. The motor vehicle door of claim 10 wherein the gripping region extends at an angle of between 0° and 90° with respect to the horizontal.

13. The motor vehicle door of claim 10 wherein the gripping region extends at an angle of between 20° and 60° with respect to the horizontal.

14. A vehicular door handle, comprising:

a substantially U-shaped body with first and second parallel legs connected by a base member, the member extending perpendicular to an inside door panel;

wherein the first leg has a gripping region, a mounting region on the second leg attaches the handle to the panel, and the legs point in substantially the same direction whereby perpendicular forces applied to the gripping region substantially avoid creating torque at the mounting region.

15. An inside door handle for an interior door panel of a motor vehicle, comprising:

a substantially U-shaped body with first and second leg portions connected by a base member, wherein the base member extends perpendicular to the door panel;

wherein a gripping region is formed on the first leg portion for grasping of the handle by a user, wherein a mounting region is formed on the second leg portion for attaching the handle to the inside of the door panel, and wherein the first and second leg portions point in substantially the same direction parallel to the door panel so that door opening and closing forces applied to the gripping region substantially avoid creating torque at the mounting region;

wherein at least two mounting bores are provided in the mounting region, and wherein the base member is twisted between the two leg portions such that the mounting bores are slightly uncovered by the first leg portion only to an extent that door opening and closing forces applied to the gripping region substantially avoid creating torque at the mounting region.

* * * * *